United States Patent [19]

Fisher

[11] 4,050,215

[45] Sept. 27, 1977

[54] PREMANUFACTURED MODULAR HOUSING BUILDING CONSTRUCTION

[76] Inventor: John Sergio Fisher, 2102 Euclid Ave., Syracuse, N.Y. 13224

[21] Appl. No.: 458,673

[22] Filed: Apr. 8, 1974

Related U.S. Application Data

[63] Continuation of Ser. No. 243,750, April 13, 1972, abandoned, which is a continuation-in-part of Ser. No. 36,175, May 11, 1970, abandoned.

[51] Int. Cl.[2] ..... E04B 1/348

[52] U.S. Cl. ..... 52/79.3; 52/79.14; 52/122

[58] Field of Search ..... 52/79, 122, 615, 236, 52/DIG. 6

[56] References Cited

U.S. PATENT DOCUMENTS

| | | | |
|---|---|---|---|
| 2,287,229 | 6/1942 | Carpenter | 52/79 |
| 3,258,889 | 7/1966 | Batcher | 52/615 |
| 3,377,755 | 4/1968 | Stacky | 52/79 |
| 3,678,637 | 7/1972 | Klipfel | 52/79 |
| 3,680,273 | 8/1972 | Bigelow | 52/122 |
| 3,683,571 | 8/1972 | Walz | 52/122 |
| 3,703,058 | 11/1972 | Klett | 52/79 |

FOREIGN PATENT DOCUMENTS

| | | | |
|---|---|---|---|
| 228,412 | 1/1959 | Australia | 52/79 |
| 1,400,050 | 4/1965 | France | 52/79 |
| 1,461,555 | 12/1966 | France | 52/79 |
| 65,124 | 1/1969 | Germany | 52/79 |
| 530,372 | 7/1955 | Italy | |
| 431,912 | 9/1967 | Switzerland | 52/79 |
| 17,763 | 11/1895 | United Kingdom | 52/DIG. 6 |

*Primary Examiner*—Price C. Faw, Jr.
*Assistant Examiner*—Henry Raduazo
*Attorney, Agent, or Firm*—Owen, Wickersham & Erickson

[57] ABSTRACT

A modular plural-story building construction system having (a) a series of rectangular modules, each having only two bounding planes for transmitting vertical loads opposite each other and joined by a floor panel and open on top, and (b) a series of rectangular modules, each having only two bounding planes for transmitting vertical loads opposite each other and joined by both a floor panel and a ceiling panel. The (b) modules are used only on the top story, and the (a) modules are used for all lower units. The modules on each level are installed with conjugation of the location of the bearing walls, i.e., so that the bounding planes for transmitting vertical loads of any one module lie perpendicular to the planes of the bounding planes for transmitting vertical loads of all immediately adjacent modules on the same level. The modules on successive levels are arranged so that the bounding planes for transmitting vertical loads above are aligned with those below.

18 Claims, 33 Drawing Figures

LEGEND

↔ DIRECTION OF SPAN AND REINFORCING STEEL

↓ BEARING WALL TRANSMITTING LOADS TO GROUND WITH VERTICAL STEEL

B. W. = BEARING WALL

PREMANUFACTURED MODULAR HOUSING BUILDING CONSTRUCTION

This a continuation of application Ser. No. 243,750 filed Apr. 13, 1972, now abandoned, which was a continuation-in-part of application Ser. No. 36,175, filed May 11, 1970, now abandoned.

BACKGROUND OF THE INVENTION

This invention relates to housing construction employing three-dimensional modules.

Government housing experts have stated that this nation's projected demand for 26 million housing units over the next 10-year period can be achieved, if at all, only through industrialized or factory-produced housing. Many manufacturers who are aware of this have been developing, and some have already built, particular kinds of industrialized housing units, each of which, no matter what the material, can be generally characterized as belonging to one of three basic structural or envelope systems or to combinations of them:

1. skeletal, with components (structural frame with in-filled non-bearing wall panels),
2. panel, with components (structural floor and wall panels),
3. three dimensional or modular, with or without major components (boxes or sections of houses or buildings).

Of these three, modular systems allow the most work to be done in the factory and necessitate the least amount of work in the field, and the present invention relates to a basically modular system. Factory premanufacturing and prefinishing can be most completely realized by the modular system, and to do so has many advantages. For one thing, factory wages are substantially less than field wages. Also, a factory generally offers better working conditions and can accommodate year-round work. Further, factory work can have a one-shop jurisdiction, which can mean more efficient operation, because any one man is able to do more than one task. In addition, assembly line efficiency is greater than on-site work.

Most multi-family modular systems in use today call for the units to be partially or fully pre-finished in the factory, so that interior partitions, doors, fixtures, equipment, windows, etc., are installed in the modules in the factory. However, when the fully pre-finished modules have heretofore been assembled into a building, assembly has resulted in redundancy of materials, i.e., double walls or double floors. Cost estimates indicate that this redundancy typically adds to the cost 80¢ to $1.60 per square foor of floor area, depending upon the system and the area. Moreover, most of such systems have been based upon a mobile home sectionalized unit — a very inflexible system for different-unit distributions and packing possibilities.

On the other hand, where heretofore attempts have been made to eliminate redundancy, wherein modules are stacked in an alternating or checker-board pattern, developing so-called "free spaces," it has been very difficult to finish the free spaces at the factory, and as a result, the cost of on-site finishing has been increased by approximately $1.00 to $2.00 per square foot. Also, the economic need to have bathrooms and kitchens in modules rather than as "free" spaces, so that they could be preassembled, has been a restraint on the flexibility of these non-redundant systems heretofore available.

The present invention solves the problem of the doubling of floors and doubling of walls — that is, the problem of redundancy of materials — and it also solves the problem of flexibility.

SUMMARY OF THE INVENTION

In this invention, a basic plan element consists of a square or rectangular module. The constraints on the size of this module come from shipping problems, i.e., the maximum size which is economically allowable under the trucking law of the state or states where the module is to be transported. The module can have any square or rectangular plan dimension, such as twelve feet square. In states where up to fourteen foot widths are allowed, it could be a combination of 14-foot square and 12-foot square modules. In cases where it may be economical to ship by helicopter, there is less constraint on the shape and plan size. The plan shape is not necessarily limited to a square, though a square is generally the basic shape. Rectangular sizes are also a part of the system, and they may be considered as a reduction in one dimension from the square module to achieve a desired area.

The system of this invention employs two basic elements which are added to, filled into, and embellished, all as called for by the particular plan they are employed in. These two basic elements are:

a. a first type of module having two parallel bearing walls (or vertical load-transmitting bounding planes) joined together by a floor. The other two opposite sides are either open or have non-bearing walls, and the top is open. From the standpoint of bearing walls or bounding planes that transmit the vertical load, this type of module can be termed "U-shaped" or "U-shaped" in vertical cross-section."

b. a second type of module differing from the first module in having a roof system or ceiling panel, in addition to the two bearing walls on opposite sides, the floor, and the two open or non-bearing ends. From the standpoint of bearing walls or bounding planes that transmit the vertical load this second module may be termed "tubular" or "tube-shaped in vertical cross-section."

The first or "U-shaped" module has no roof or ceiling. It can be braced during transportation. When the "open" end of either kind of module requires an exterior wall or a partition between spaces, non-bearing walls are inserted, and these walls may be an acoustical separation wall between two apartments. When the system of this invention is used in wood buildings up to four stories high, depending upon governing codes, the "U-shaped" module is used on all the lower stories. The top story necessitates the other basic element, the "tube-shaped" module. When the system is used in concrete buildings, considerably higher structures are quite feasible, and again only top-story modules are "tubular," the others being "U-shaped."

These two basic modules are packed together to build the final structure. On any one floor the modules are conjugated so that there are no double walls; moreover, when placing either a "U-shaped" module or a "tube-shaped" module upon a lower "U-shaped" module, there are no double floors. This avoidance of redundancy by mating and placing of the "U-shaped" and "tube-shaped" modules is a basic principle by which great economy and flexibility can be achieved. Also, a 12 × 12 foot module has almost no limitations in the manner in which a bearing wall may be opened up for spatial flow from one space to another, and it allows almost infinite flexibility for many different plan types.

The fact that the module can be adjusted to various sizes further increases its flexibility. The modules are prefinished as much as possible in the factory; exactly how much depends upon the specific manufacturer and on the governing codes and union agreements.

The four main objectives of the system of this invention are (1) to maximize the factory work, (2) to minimize field work, (3) to eliminate redundancy of materials, and (4) to allow for infinite flexibility of planning possibilities. The basic characteristics of the system are (1) the use of "tube-shaped" modules on top of one or more levels of "U-shaped" modules, and (2) the conjugation of modules on the same floor level, whereby the elimination of redundancy of materials is achieved.

The modules of this invention are easily lifted by helicopter, are easily transportable by truck, and are easily set in place by a light crane; they are economical, flexible elements. The simple concept of this system can be organized to conform to any way of living. This system can be used for two-, three-, four-, and five-bedroom townhouses and for one-, two-, three-, four-, and five-bedroom flats and from two to twenty-four stories, depending on the structural material, and the drawings herein show, among other things, the principle applied to a specific design for a three-bedroom townhouse which meets HUD and FHA requirements.

Other objects and advantages of the invention will appear from the following description of a preferred embodiment, given as an example and in no way intended to limit the invention to a particular height or size of building, to any particular floor plan or exterior design, or to a particular type of house or building.

BRIEF DESCRIPTION OF THE DRAWINGS

In the drawings:

FIG. 19 is a fragmentary view in elevation and section of the connection of a typical "U-shaped" module to another "U-shaped" module of FIG. 9, just over the foundation.

DESCRIPTION OF SOME PREFERRED EMBODIMENTS

Figure 1:
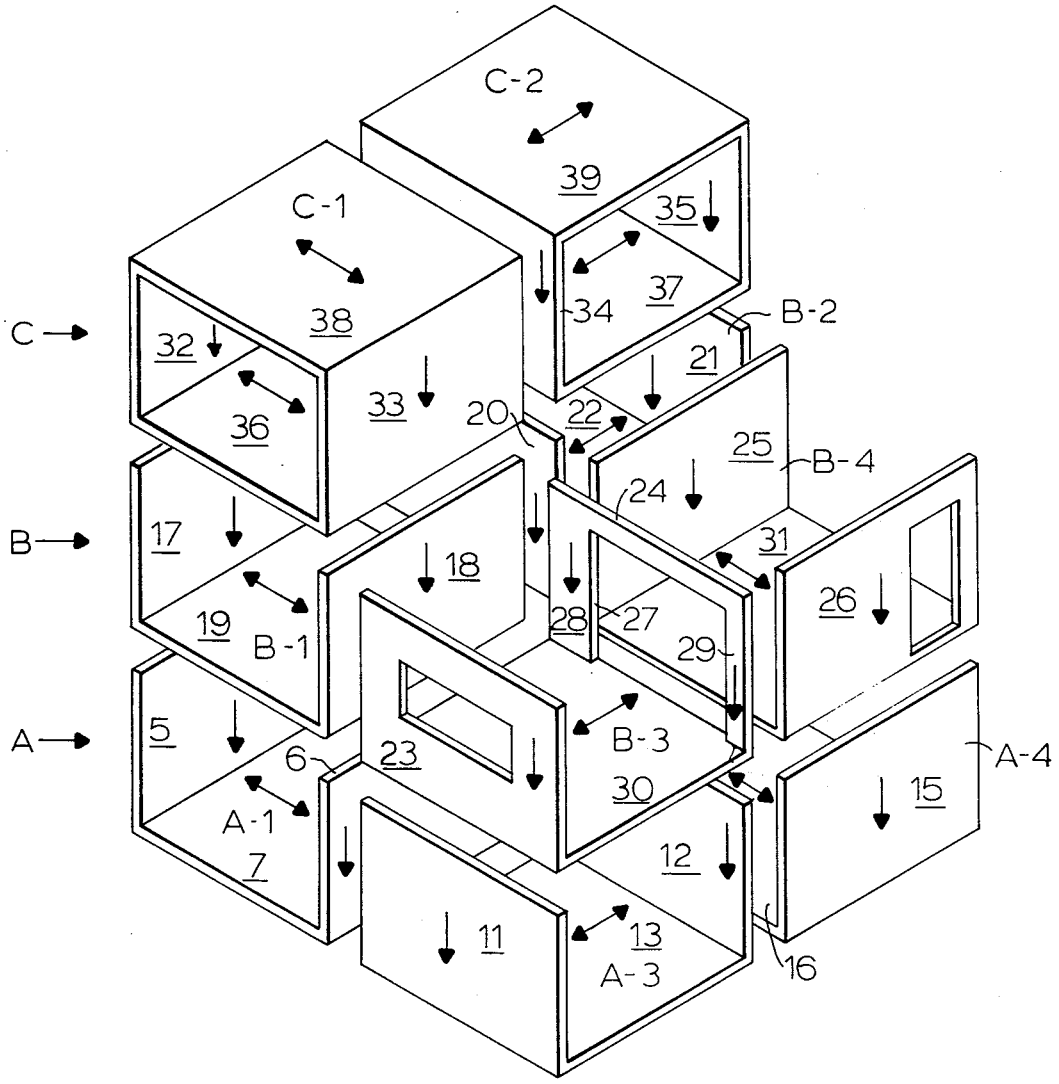
FIG. 1 is a diagrammatic view in perspective, partially exploded, of an incomplete stage of building a multi-story building according to a system embodying the principles of the present invention, employing modules made from reinforced concrete. The legend on the drawing shows that arrows indicate the directions of the span and reinforcing steel on the horizontal portions and indicate the direction of load on the bearing walls, with vertical reinforcing members transmitting the loads to ground.
Figure 3:
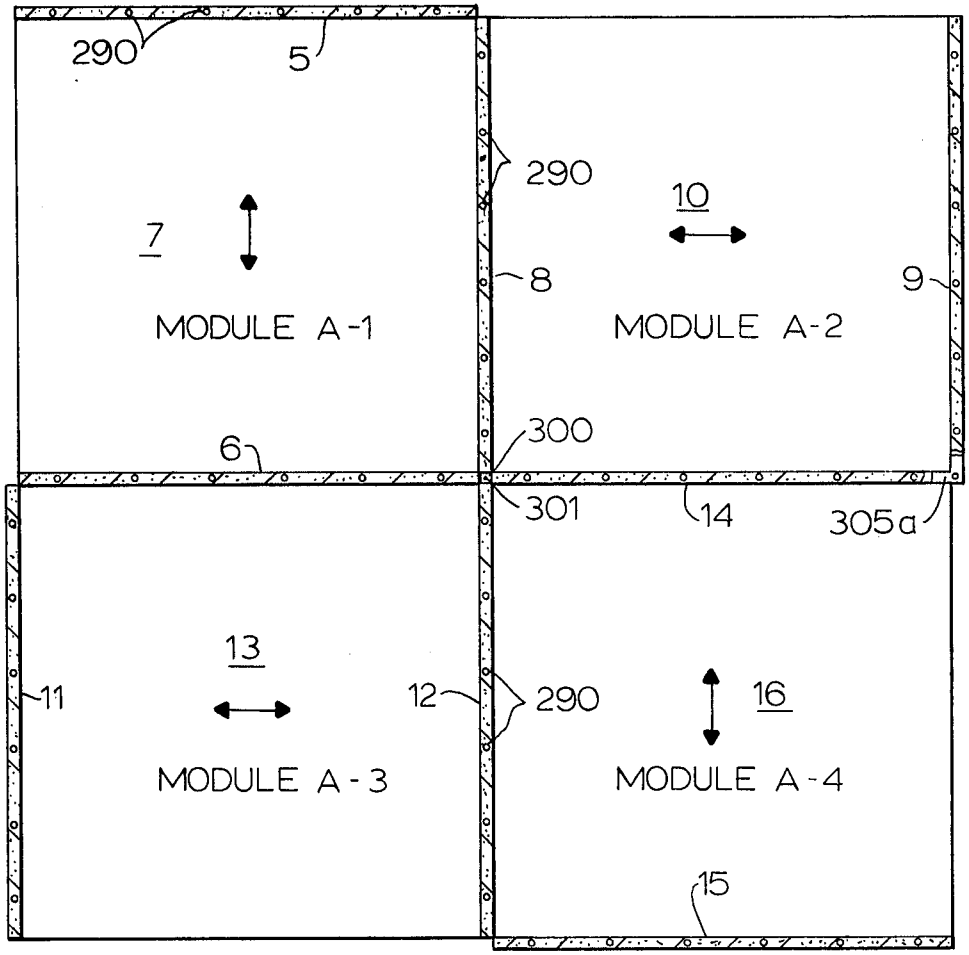
FIG. 3 is a diagrammatic view in horizontal section of one level of a building employing a series of "U-shaped" modules of this invention, each module having two bearing walls shown in section joined by a floor, with the direction of the spanning steel in the floor being indicated by arrows. The view illustrates the conjugation of modules on the same floor level and a portion at the left is shown in top plan.
Figure 2:
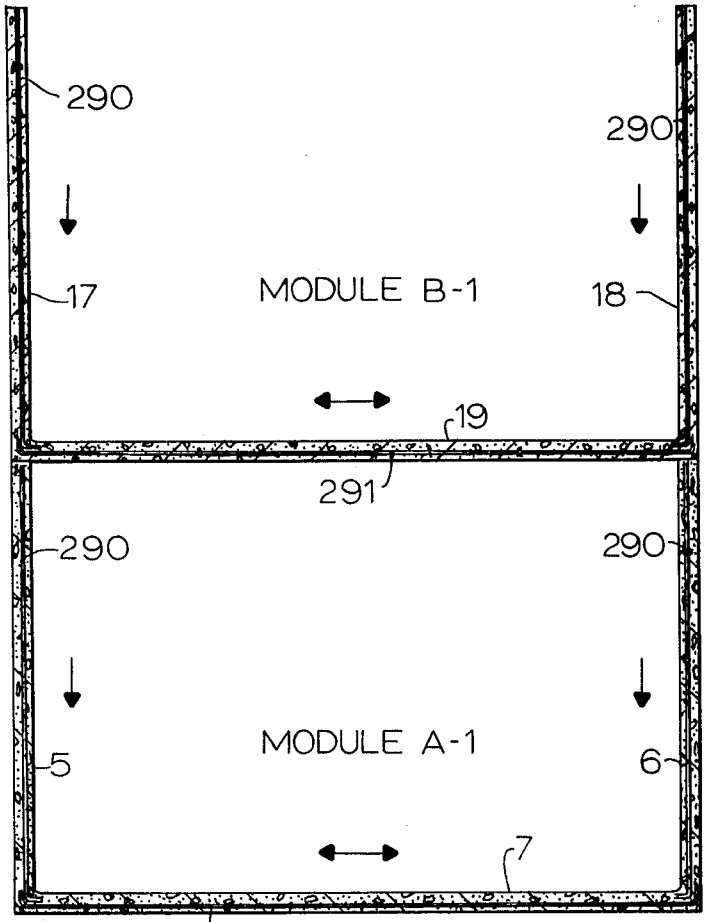
FIG. 2 is a view in vertical section, on an enlarged scale with respect to FIG. 1, taken through a lower portion of a building embodying the principles of the present invention, arrows again showing the direction of the spanning or bearing steel in two stacked "U-shaped" modules, each having two parallel bearing walls with a spanning floor between them.

Some Basic Principles about the Modules (FIGS. 1-3)

FIGS. 1-3 give in diagrammatic form the basic principles of construction of a building embodying the present invention made from a series of modules, of the two types generally described above, namely, (1) a "U-shaped" module in which the load bearing structure, as seen in cross section, comprises two parallel vertical load-bearing structures joined by a single horizontal structure with its load-bearing structure spanning between the two parallel vertical load-bearing structures, and (2) a "tube-shaped" module in which there are two parallel horizontal structures spanning between the two parallel vertical load-bearing structures. Architecturally, the "U-shaped" module is thought of as two parallel bearing planes joined by a floor, and the "tube-shaped" module is thought of as of two parallel bearing planes joined both by a floor and a ceiling. However, one must be careful not to equate "bearing plane" to a partition. Some bearing walls are not partitions and some partitions are not bearing planes. Thus, in this invention, the bearing wall is characterized by having a plurality of vertical-load supporting members — such as steel reinforcing in a concrete wall or vertical lumber structure capable of bearing heavy loads. The bearing "plane" may be opaque, with a solid partition, or it may include doors, windows, or may even be almost completely open, so long as it has adequate vertical-load-bearing columns. The floor and ceiling joists span between the bearing planes in this invention.

The modules are basically cubes (although they need not always be square in plan), and the two sides not comprising "bearing walls" are not used for load bearing. These two sides may be open, as shown in FIG. 1, or may be closed by curtain walls, and where curtain walls are used, there may be openings. In calling the module "U-shaped", it is the load-bearing structure that is being considered, not the skin effect or visual appearance.

In FIGS. 1-3 steel-reinforced concrete modules are shown, and the showing is largely diagrammatic in order to show the principles of the invention more clearly. Three levels A, B, and C are shown in FIG. 1; only two levels A and B are shown in FIG. 2, and only one level A is shown in FIG. 3.

For simplicity's sake, the four modules A-1, A-2, A-3, and A-4 on the bottom level A of FIG. 1 — and in FIG. 3 — are shown as identical, all "U-shaped" in vertical cross section with two parallel bearing walls and a floor. On the next level B the modules B-1, B-2, B-3, and B-4 are the same basic type as the modules A-1, etc., but are shown with minor differences between them, there being openings through some of the bearing walls. Above the two modules B-1 and B-2 are modules C-1 and C-2 of the second or "tube-shaped" type in which there are both floors and ceilings, though again there are only two bearing walls.

Conjugation and Stacking (FIGS. 1-3)

A key feature of the invention, as shown in FIGS. 1 and 3, is that on any one floor level the modules are conjugated. Thus the two bearing walls 5 and 6 of the module A-1 are joined by a floor 7 and lie perpendicular to the direction of the bearing walls 8 and 9 of the module A-2 with its floor 10 (see FIG. 3) and the bearing walls 11 and 12 of the module A-3 with its floor 13. Similarly, the module A-4 has bearing walls 14 and 15 joined by a floor 16, and the walls 14 and 15 are perpendicular to the direction of the walls 8, 9, 11, and 12. This is conjugation and is a very important characteristic of the invention.

Figure 7:
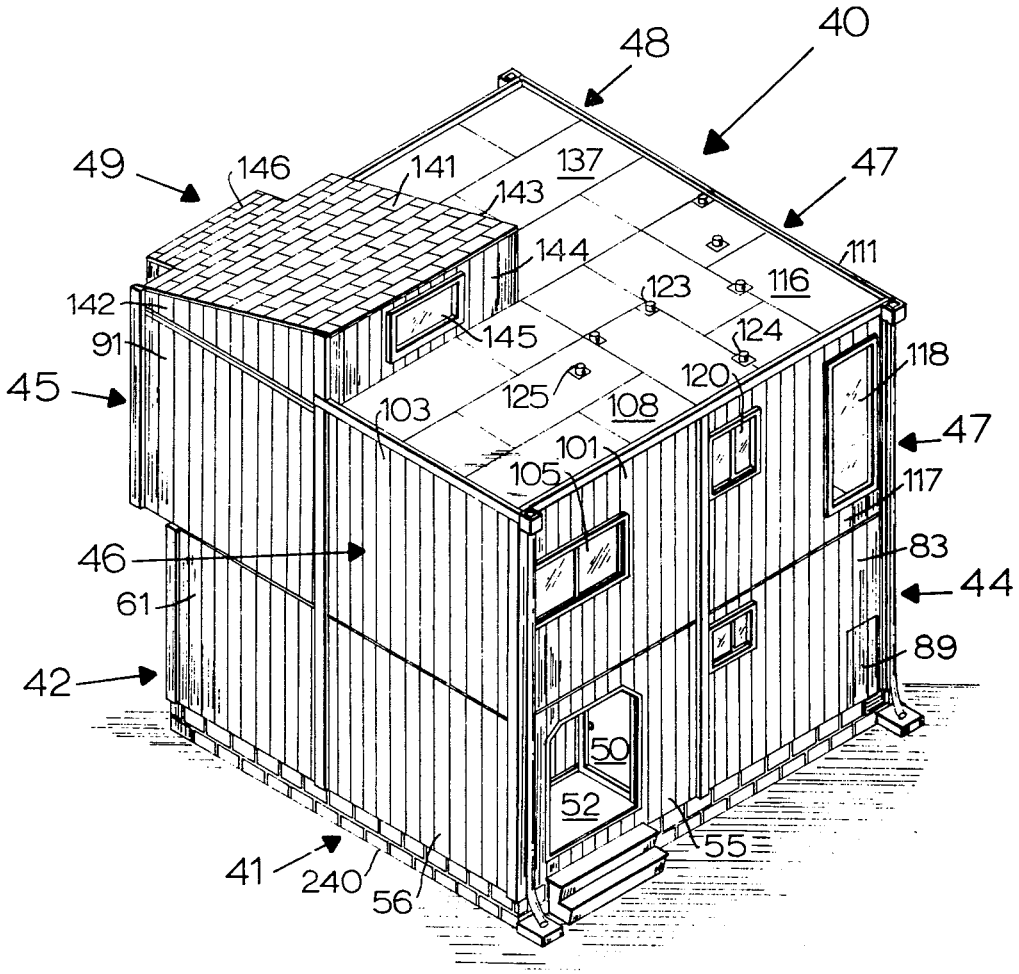
FIG. 7 is an isometric view of a wooden building embodying a modified form of the principles of the invention, namely, a three-bedroom house, shown with all walls completed, but with the roof left incomplete, to expose the roof substructure.

Another basic feature of the invention is that from story to story the modules that are superimposed have their bearing walls aligned, so that they can carry their loads right down to the foundation. Thus, in FIGS. 1 and 2 the bearing walls 17 and 18 of the module B-1 directly overlie the respective bearing walls 5 and 6 of the module A-1 and the floor 19 of the module B-1 spanning between the walls 17 and 18 carries its load out and rests it on the bearing walls 5 and 6. The bearing walls 20 and 21 of the module B-2, 23 and 24 of the module B-3, and 25 and 26 of the module B-4 respectively directly overlie the walls 8 and 9 of the module A-4. In some cases, there may be overhangs and cantilevers for architectural features, as shown in FIG. 7, but generally the structure shown in FIG. 1 is used, and it will be appreciated that variations by way of cantilever and such are still fundamentally the same in principle.

This system of conjugation and stacking, using ceilingless "U-shaped" modules on all except the top floor of each stack, makes it possible for the modules to be 100% prefinished without having redundant (double) walls or floor-ceiling panels in the finished structure.

While any of the walls shown as bearing walls may be perforated to provide doors, windows, and passageways, so that the wall itself may not provide a complete curtain, nevertheless the main function of bearing is performed by these bearing walls. Thus, in the module B-3 shown in FIG. 1, a large opening 27 enables communication between rooms, but this is not detrimental in the least to the wall 24 performing its bearing function, for the steel-reinforced vertical portions 28 and 29 placed in this particular wall do that. The same holds for a window opening in the wall 23 and a door opening in the wall 26.

Bearing walls 32 and 33 of the module C-1 rest on the bearing walls 17 and 19 of the module B-1 and transmit the load down to the bearing walls 5 and 6 of the module A-1; similarly bearing walls 34 and 35 of the module C-2 rest on the bearing walls 20 and 21 of the module B-2 that transmit their load down to the bearing walls 8 and 9 of the module A-2.

Any of the non-bearing areas at the ends of the bearing walls may have curtains or partitions of any type of structure across them to close or partially close the ends of the modules. Partitions may also be located anywhere else they are desired. This will be further illustrated in FIGS. 7 et seq. The curtain may be glass, wallboard, wood, or even concrete, but no load-bearing steel reinforcing members are required for a concrete building, and, if used, they are wasted, for they would perform no useful function, and that is why they are omitted; such walls do not perform any real bearing function, and they usually cannot, since they usually rest on open space below them or on other light, nonstructural curtain walls below them. These curtain walls may be exterior walls or interior walls. They may give the appearance of solidity, particularly if they are exterior walls, but that does not mean that they perform any bearing function. An important feature of the present invention is that non-bearing walls do not perform a bearing function and that a bearing function is performed by the two parallel bearing walls — no matter which walls are "solid" or perforated.

Another feature of the invention is that the floors 7, 10, 13, and 16 of the generally "U-shaped" modules A-1, A-2, A-3, and A-4 are each provided with span and reinforcing steel to carry the load of each floor out to the edges where it can rest on the bearing walls or foundation structure beneath it. Note that the spanning steel is always in a direction spanning the two bearing walls, and not in the other direction. The same is true of the floors 19, 22, 30, and 31 of the modules B-1, B-2, B-3, and B-4 and of the floors 36 and 37 and the ceilings 38 and 39 of the modules C-1 and C-2. This is a standard feature of the invention in all its forms, whether concrete or wood be the structural material. The use of the bearing walls for bearing, irrespective of whether they are solid or partly perforated or largely perforated, and the use of the curtain walls as only curtains, irrespective of whether they are solid or perforated or all open, and the use of the floors to transmit the forces therein out to the bearing walls is universally practiced in the present invention. Indeed, the two types of modules differ from one another only in that the "tubular" ones like the modules C-1 and C-2 used at the top level of any column or stack of modules have their own integral ceilings 38 and 39, and there again, the load is carried to the bearing walls 17, 18 and 20, 21 below them and extends across them rather than having the steel extend in a different way.

Manufacture and Prefinishing of the Modules

The concrete modules may be vertically cast in a factory and then rotated into a horizontal position, which becomes the pre-finishing position for pre-installing baths, kitchens, painting, etc. The bearing walls have what will become vertically extending reinforcing steel 290 (see FIGS. 2, 3, and 6) cast in them, preferably centrally, in the form of reinforcing rods or welded wire fabric in order to transmit the vertical loads, and the floors have horizontally extending spanning or reinforcing steel 291 cast in them and spanning between the bearing walls and lying below the center of the floor slab. The infill or curtain walls perpendicular to the bearing walls can be left open, or enclosed with glass or wood or any material, including the same concrete of the bearing wall but omitting the vertical load bearing steel. Curtain walls furthermore do not need to have any lateral strength for wind or seismic (earthquake) forces, because the conjugation of the bearing walls automatically creates a strong shear wall system without relying on the curtain walls.

The "U-shaped" modules are always conjugated or tessalated in their lower floors of the multi-story housing structure. Being 90° "rotated" (according to the rules of symmetry or crystallography) in a horizontal plane, they form a close packed tessalation without a double wall. When these "U-shaped" modules are stacked directly on top of each other so that their bearing walls align and transmit the forces of the floor of the module area, there is no redundancy of floor (no double floor).

The rectangular "tube-shape" module is made in the same manner as the "U-shaped" module except for its ceiling or roof.

A Connection System for Concrete Modules (FIGS. 3–6)

The modules are connected together in a distinctive manner whereby the prefinishing is not disturbed, or dirtied in any manner. The principle is that the connection system is exterior to the prefinished space and does not require a workman to enter the prefinished space, yet this system is strong enough to withstand all necessary forces, including earthquakes. When the conjugated modules come together in plan (as in FIG. 3) and when they all have a free floor area which is square, there is a square space 300 between the intersection of modules.

Figure 4:
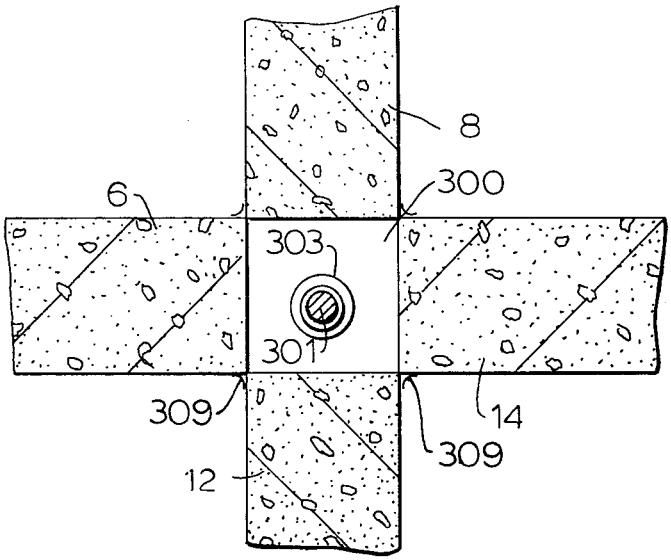
FIG. 4 is a fragmentary enlarged view in horizontal section of the central portion of FIG. 3, where four modules meet.

FIG. 4 shows the center portion of FIG. 3 and illustrates a specific examples of how the structure may be tied together at locations where four bearing walls 6, 8, 12, and 14 meet at a common intersection and surround a square open area 300. Within this square open area 300 the present invention provides a connection rod 301, such as a $\frac{5}{8}$ inch diameter steel rod. Near its upper end 302 the rod 301 has an enlarged bulkhead 303 and above that a threaded portion 304. Thus, for example, if the bearing walls are 4-inch concrete with $\frac{1}{2}$ inch steel reinforcing, they leave a 4-inch by 4-inch vertically open chase 300, and in this chase may be a $\frac{5}{8}$ inch connection rod 301 with a bulkhead 303 2 inches in diameter.

Figure 5:
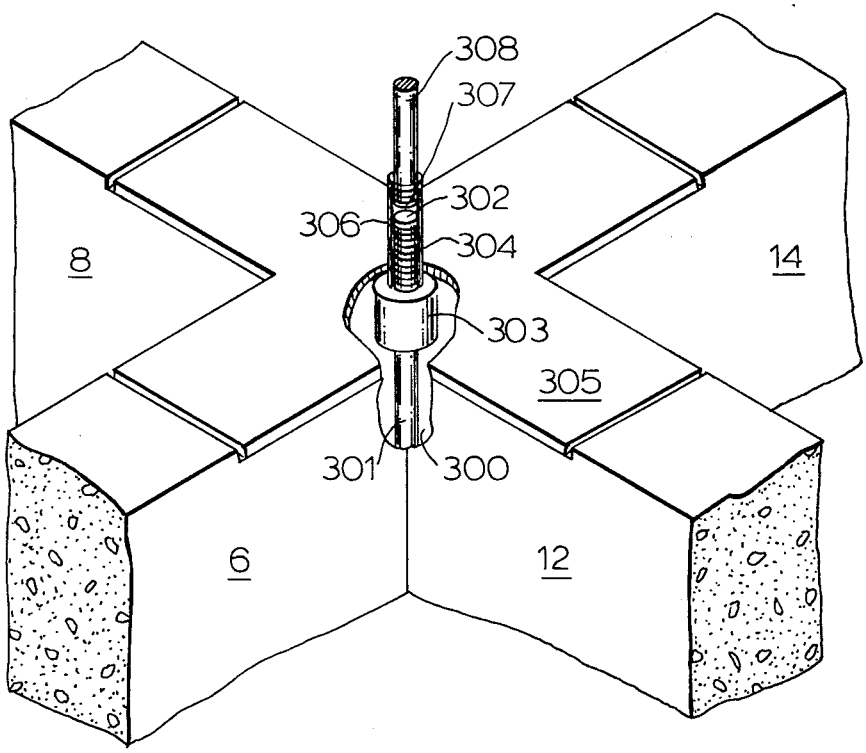
FIG. 5 is a fragmentary view in perspective of the upper edge of the central portion shown in FIG. 3.

At the top of each level, where the four walls 6, 8, 12, and 14 come together, as shown in FIG. 5, a $\frac{1}{4}$ inch thick cross-shaped steel plate 305 may be provided, held securely in place by a sleevelike interiorly threaded nut 306 that is threaded to the rod 301 and bears on top of the plate 305 and to which is threaded the lower end 307 of another rod 308 like the rod 301. The spaces 300, therefore, need not be filled with concrete, and yet the modules are held securely together, both on their own level and from level to level, once the whole connected rod system is tensioned from above with a pneumatic tool. Where only two bearing walls 9 and 14 come together there may be a similar structure using an L-shaped plate 305*a*. Sealing at the junctures may employ plastic or wood trim 309.

Figure 6:
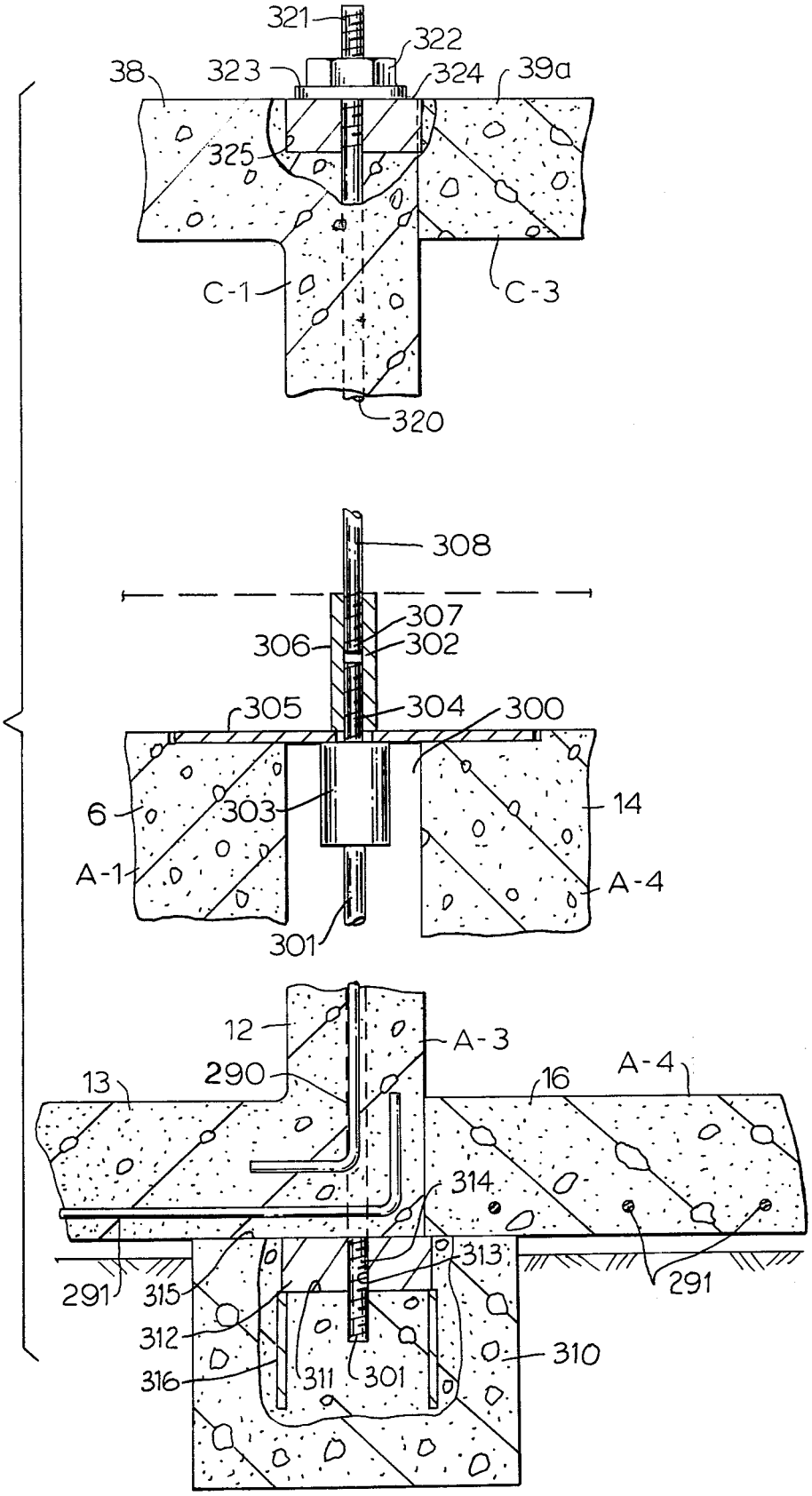
FIG. 6 is a fragmentary view in vertical section of a portion of a building like that of FIG. 1, showing at the top a juncture of two "tube-shaped" modules, then, after a break, a location like that in FIGS. 4 and 5, and then, after another break, a bottom portion resting on the foundation.

Assuming for the moment that the lowest level A is concerned and that the modules A-1, A-2, A-3, and A-4 rest on the foundation for the building, the rod 301 is also used to secure these four modules to a foundation pier or footing 310 (see FIG. 6). In a recess 311, the footing 310 is provided with a steel plate 312 having an interiorly threaded opening 313 into which a lower threaded end 314 of the rod 301 is threaded. As a result, the floors 13 and 16 not only rest on the upper surface 315 of the footing 310 but are held there securely. Welded to the corners of the plate 312 are hard grade steel dowels 316 (e.g., ⅝ inch dowels) that extend down into the footing 310.

The rod 308 extends up from its anchor sleeve 306 to the next level, where a plate like the plate 305 is again secured in place, and a new rod extends thereabove, and so on to the top of the building.

When one of the "tube-shaped" modules C-1 is placed at the top of a stack of what are otherwise "U-shaped" modules B-1 and A-1 and perhaps other modules, a post-tensioning rod 320 generally like the rods 301 and 308 is provided. The rod 320 has a threaded upper end 321, to which a nut 322 is secured. The nut 322 bears through a washer 323 on a steel tensioning plate 324, which is cast in a recess 325 in the module C-1. The whole assembly is then pneumatically drawn tight or post-tensioned, so that all the modules below are held together by the friction and force of post-tensioning.

Description of a Preferred Embodiment in Wood

Figure 8:
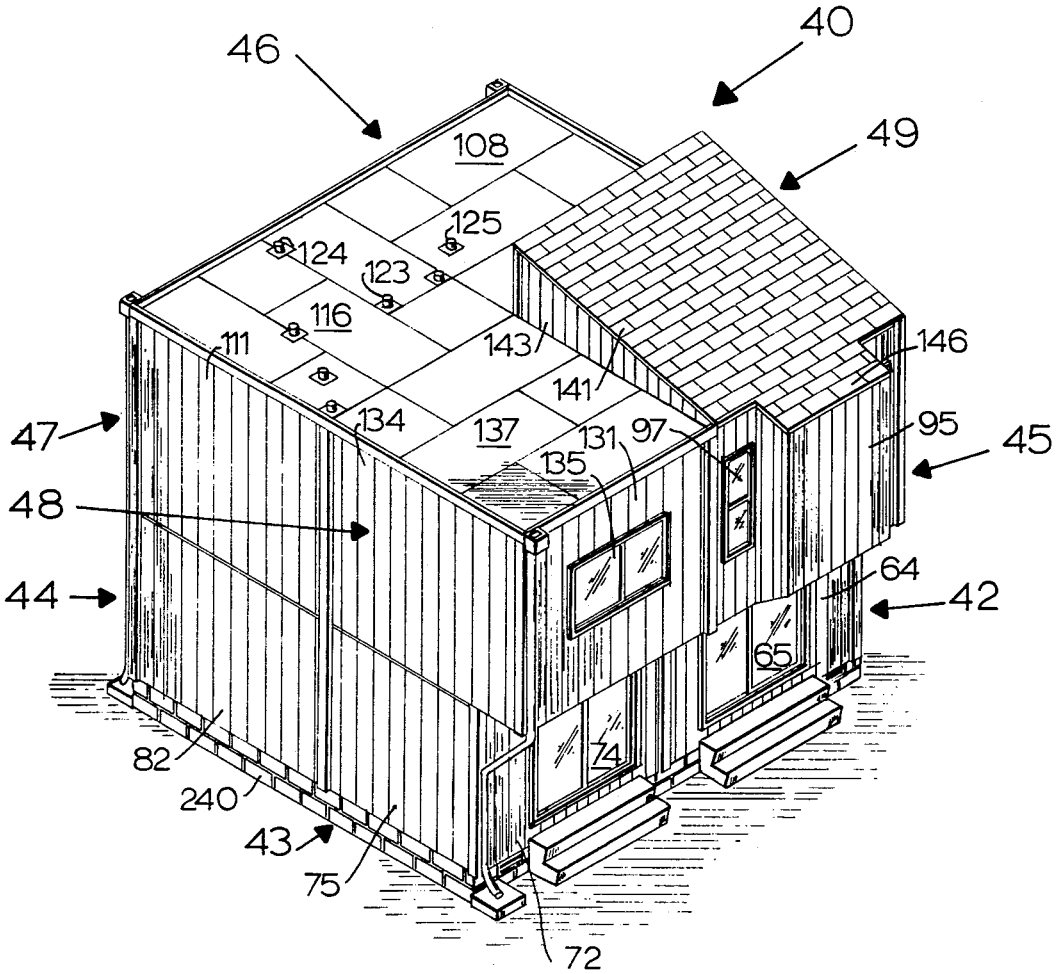
FIG. 8 is an isometric view of the building of FIG. 7 in the same state of completion from a different viewpoint.
Figure 9:
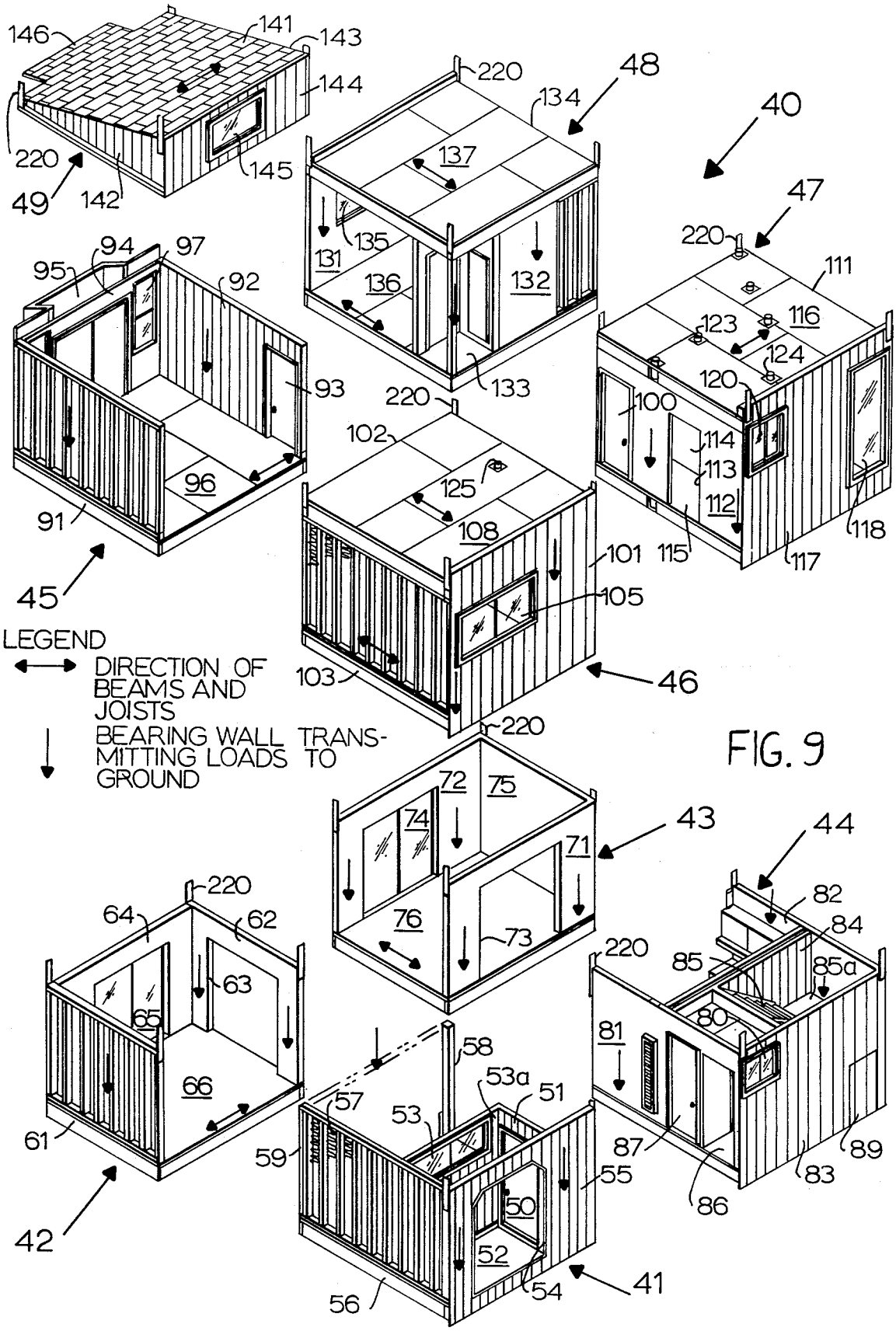
FIG. 9 is an exploded view of the building of FIGS. 7 and 8, showing the modules of which it is comprised, but with the walls on two sides unfinished and suitable for attachment thereto of similar walls. As in FIG. 1, arrows indicate the directions of floor and ceiling joists and of the vertical bearing members in the bearing walls.
Figure 10:
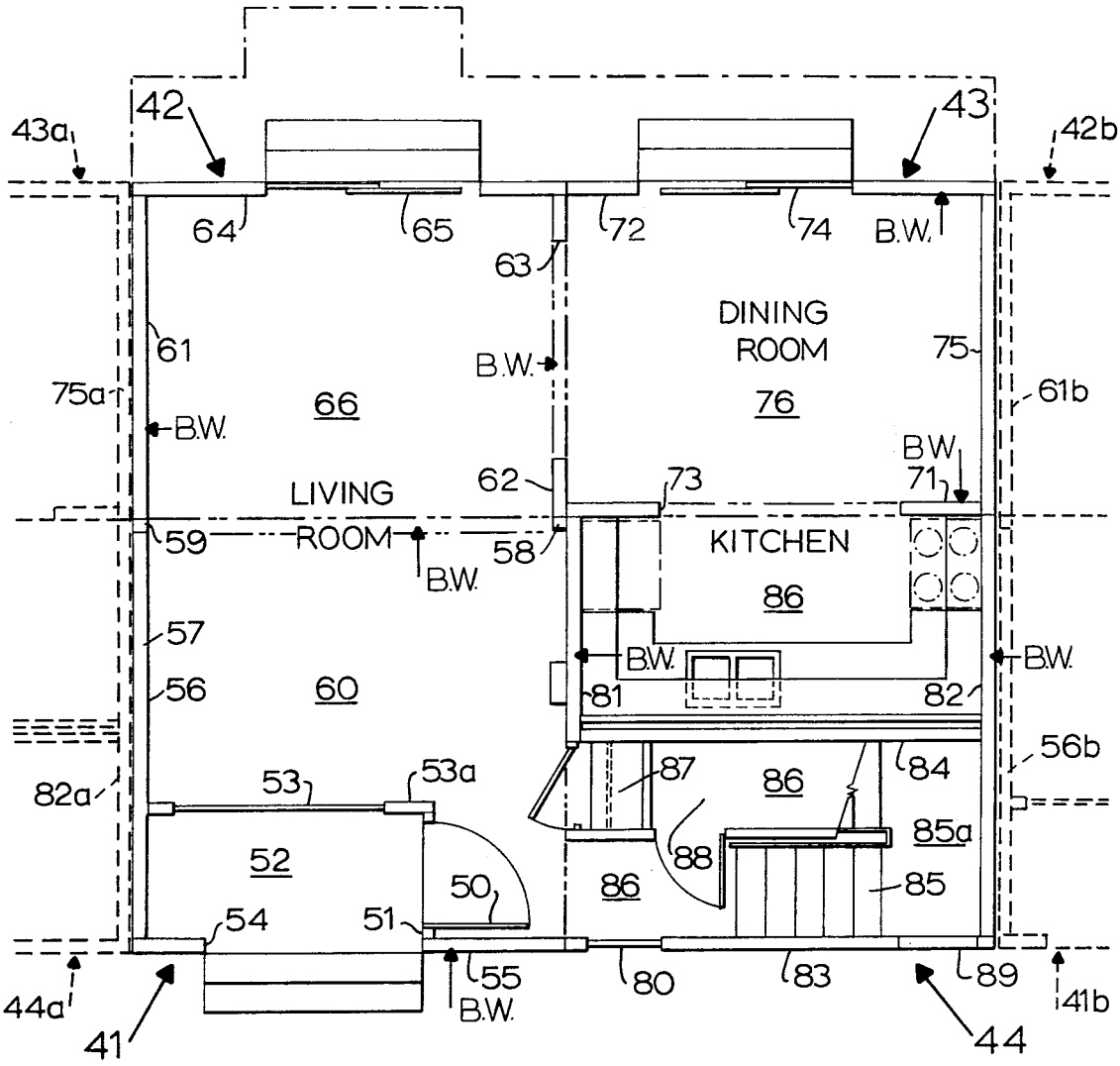
FIG. 10 is a floor plan view of the lower floor of the building of FIGS. 7 and 8. Dot-dash lines at the top show the area overhung by the upper floor. Broken lines to left and right show portions of two adjoining units of the same type. Dot-dash lines in the floor plan show the modules' boundaries. Bearing walls are indicated by the legend "BW".
Figure 11:
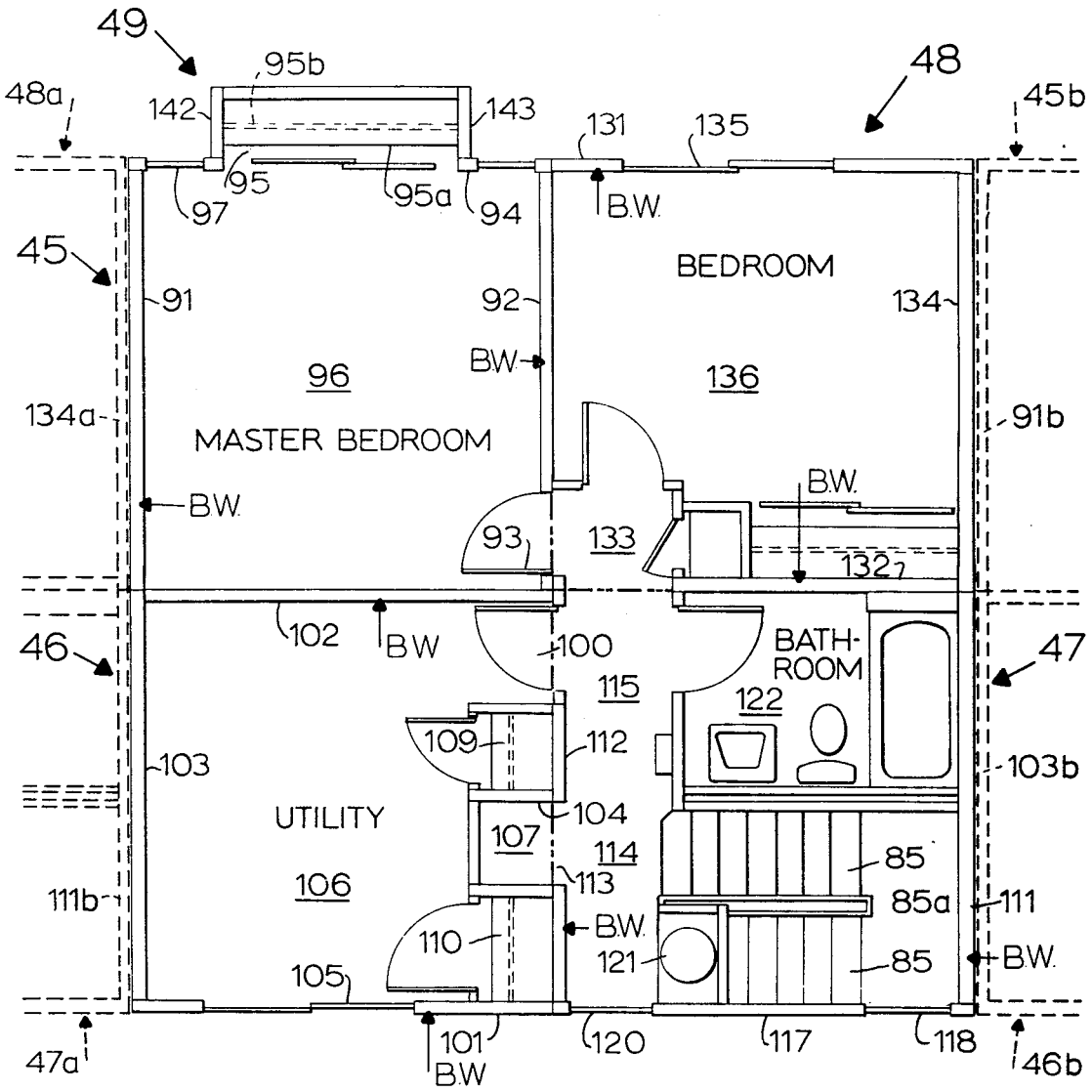
FIG. 11 is a floor plan view of the upper floor of the same building of FIGS. 7 and 8. Again, portions of two adjoining units are indicated by broken lines and the module boundaries inside are indicated by dot-dash lines, and bearing walls are labeled "BW".

FIGS. 7 through 9 show a three-bedroom two-story townhouse 40 made according to the invention, but in wood instead of concrete as in FIG. 1. This townhouse 40 may be free standing, as shown in FIGS. 7 and 8, or may be attached on two walls to another similar or identical structure, as shown in FIGS. 10 and 11. The house 40 comprises four "U-shaped" modules 41, 42, 43, and 44 on the ground floor and one "U-shaped" module 45 on the upper floor. It also includes three "tube-shaped" modules 46, 47, and 48 on the upper floor and one inverted "U-shaped" module 49 providing a roof with a clerestory over the module 45.

The various modules will be described as examples of how the invention may be used and then their assembly will be described. It will be noted that "tube-shaped" modules are here used only over "U-shaped" modules and always for the top unit in any stack. Only "tube-shaped" modules would be used in one-story construction. Note that whether a module is "U-shaped"depends not on whether it has two, three, or four walls, but on whether it has two parallel bearing planes and no other bearing planes. Similarly, a "tube-shaped" module has two parallel bearing planes and no other bearing walls. Curtain walls may be present and bearing planes may be perforated.

Thus, as will be described in greater detail below with reference to FIGS. 7–9, the modules are U-shaped or tube-shaped in terms of the load-transmitting components (or the planes embodying such components). These components are connected together in a module in either a U-shape or a tube shape when the module is viewed from an end.

In each module shape the vertical forces of the building, from the top to the ground, are transmitted in a series of vertical load-bearing bounding planes at opposite ends (or sides) of the module and therefore spaced apart one module wide.

The tube-shaped module has both ceiling and floor panels with load-carrying spanning means extending across the tops and the bottoms of the vertical load-bearing bounding planes.

The U-shaped modules do not have ceiling panels but instead have only floor panels with load-carrying spanning means extending across the bottoms of the vertical load-bearing planes.

Thus, the two vertical load-bearing bounding planes plus the horizontal load-carrying spanning means form a U-shape when viewed end-on in an open topped, U-shaped module; and the two vertical load-bearing bounding planes plus the horizontal load-carrying spanning means form a tube shape when viewed end-on in a closed top, tube-shaped module.

As also described in greater detail below with reference to FIG. 9, the building construction system of the present invention stacks the modules in adjacent vertical stacks. All of the modules in one stack are disposed such that the vertical load-bearing walls or planes on each side of that one stack are in exact vertical alignment top to bottom. All of the vertical load-bearing walls or planes in an immediately adjacent second stack are also exactly vertically aligned top to bottom within the second stack, but the vertical load-bearing walls of the second stack are turned 90° with respect to the vertical load-bearing walls or planes in the first stack. The system thus has vertically aligned side wall stacking in columns with 90° rotation between adjacent columns.

This vertical load-bearing wall plane alignment in adjacent module stacks is shown in FIG. 9 and is described below. However, it is more clearly evident in FIG. 1.

As indicated above, the bearing walls or planes may be perforated, and this will be described in more detail below with reference to FIG. 9; but at this point it may be noted generally that the perforations may take the form of a door 73 in the U-shaped module 43 of FIG. 9, a window 105 in the tube-shaped module 46 of FIG. 9, or (in a more extreme case) the space between the wall end columns 58 and 59 in the U-shaped module 41 in FIG. 9. The module 41 (FIGS. 7, 9, and 10), which functions as a "U-shaped" module includes a main entry door 50 in a partition 51, (FIGS. 9 and 10). There is an entry porch 52 with a window 53 (FIGS. 9 and 10) in a partition 53*a* that defines one end of the living room of the house 40 (see the plan, FIG. 10). An entry archway 54 to the porch is cut out of a bearing wall 55. The entry porch 52 may be depressed and sloped for drainage, and it may be covered with a suitable covering such as an epoxy-walnut-shell coating. Joined to the bearing wall 55 is a non-bearing party wall 56 which contains acoustical insulation 57 (FIG. 9). The "wall " 56 forms an independent wall for acoustical insulation, in cooperation with a bearing wall 82*a* of an adjacent module 44*a* (FIG. 10).

In this module 41, the bearing wall opposite the bearing wall 55 is reduced to two columns 58 and 59 at the two corners, the column 59 being in the form of studs that form the end of the non-bearing wall 56. The rest of what is to serve as a bearing wall plane is open, because the module 41 is to be so combined with the module 42 that this open area faces toward an open, non-bearing side of the module 42 in order to afford a longer, larger living room than could be obtained from a single module. There is a floor 60, which may be either rough or finished. This is just an example of what can be done, of course, for many other dispositions could be made of the space of the module 41. The effect of the module 41 used here as an example is to form part of the living room and entrance porch and the outside opening for the dwelling 40 as well as the entranceway into the interior of the house.

Figure 24:
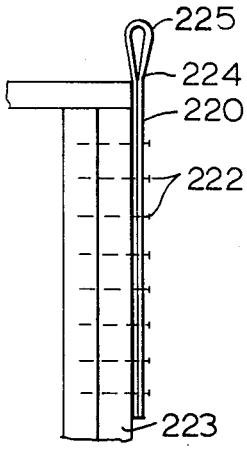
FIG. 24 is a fragmentary view in end elevation of the expandable strap of FIG. 23.

The module 42 provides the other portion of the living room. It has a bearing wall 61 which lies in a plane at right angles to the plane of the bearing wall 55. In other words the module 42 is rotated 90° with respect to the module 41, so far as the bearing-wall relationship is concerned, and this rotation or conjugation is used throughout the building made according to the present invention. Opposite the bearing wall 61 is a bearing wall 62, which has an archway opening 63 leading into the dining room provided by the module 43. The bearing wall 61, insulated, may lie against a wall 75*a* of an adjacent module 43*a.* A non-bearing side wall 64 may be provided with an aluminum sliding glass door 65 for access to a patio. The opposite side of the module 42 is completely open to afford more space for the living room. The floor 66 is continuous with the floor 60 of the module 41 and is joined to it, as shown in FIG. 24. When the two modules 41 and 42 are assembled, the walls 56 and 61 are also substantially continuous, and though they are similar in appearance, it will be noted that the wall 61 is a bearing wall while the wall 56 is a non-bearing wall.

The module 43, which here provides a dining room, has opposite bearing walls 71 and 72. The bearing wall 71 has an opening or archway 73 affording access to the kitchen, which is in the module 43, while the exterior bearing wall 72 may be provided with an aluminum sliding glass door 74 for access to a dining patio. There is a non-bearing partition wall 75 and the other end of the module 43 is completely open for connection to the bearing wall 62 of the module 42. A floor 76 is continuous with the floor 66 when the modules are assembled. Again, so far as bearing walls are concerned, the module 43 is rotated 90° from the module 42. Also the wall 75, insulated, may (as in FIG. 10) be attached to a wall 61*b* of another module 42*b.*

The remaining ground floor module 44 may be termed a lower core module because it contains the mechanical, plumbing, and electrical equipment for the ground floor. Thus, it is provided with opposite bearing walls 81 and 82 and a non-bearing exterior wall 83, while the fourth side is open. The wall 82 may be insulated and bear against a wall 56*b* of another unit's module 41*b.* The core module 44 also has an interior partition 84 and a stairway 85 with a landing 85*a,* as well as a floor 86. This module 44, when abutted against the bearing wall 71, defines a kitchen as well as a stairwell for access to the second floor, and it also defines an entry closet 87 and a storage room 88 which may be converted into a half bath. The non-bearing exterior wall 83 may have an access panel 89 for exterior storage and also for enabling one to reach the crawl space. There is also a small window 80 in the wall 83.

On the upper floor there is, as noted before, a U-shaped module 45, which provides the master bedroom in this particular floor plan (see FIG. 11). The bearing walls are all labeled "BW" in this view. Walls not labeled "BW" are not bearing walls. This module 45 has a bearing wall 91 which may form a party wall (next to a wall 134*a*of a module 48*a*) and an opposite bearing wall 92, which includes an entrance door 93. The bearing walls 91 and 92 directly overlie the bearing walls 61 and 62. An exterior non-bearing wall 94 preferably includes a protruding closet 95 with a shelf 95*a*and a pole 95*b.* The module 45 has a floor 96 and provides an open beam ceiling for the module 42 below it, and the module 45 is open at one end and at the top. It may have one or two windows 97 in the non-bearing wall 94.

It will have been noted, of course, that, as stated earlier, all of the U-shaped modules 41 through 45 have no ceiling. Each one has a floor and each has two bearing walls which face each other, although the bearing wall is in one instance reduced to a pair of posts, and they also have two open or non-bearing sides facing each other.

The module 46 which fits against the module 45 is the first tube-shaped module to be discussed. It has an exterior bearing wall 101 and an interior bearing wall 102 directly opposite, defining opposite sides of a bedroom. The position of the bearing walls 101 and 102 is rotated 90° relative to the bearing walls 91 and 92 of the module 45, and they directly overlie the bearing walls of the module 41. The is a non-bearing wall 103 on the exterior side, which may be a party wall fitting against a wall 111*a* of a module 47*a,* likewise provided with acoustical material as in the case of the wall 56, and there is another non-bearing wall 104. The exterior bearing wall 101 may have a sliding window 105 and the unit has a floor 106 and provides an open-beam ceiling for the module 41 below it. This unit is intended in this particular design to provide a space 107 for a clothes drier and therefore has a drier vent 125. There is also a ceiling 108 on this tube-shaped module. There may also be two closets 109 and 110, with doors, shelves, or poles.

The next tube-shaped module 47, which joins the module 46, has an exterior bearing wall 111 and an interior bearing wall 112, which includes a door 100 for entering the utility room of the module 46 and a recess entry 113 leading from a hall 114 at the top of the stairs 85. The module 47 has a floor 115, provides an open-beam ceiling for the module 44, and has a roof-ceiling structure 116. A non-bearing wall 117 on the exterior side may have a tall window 118 which allows light to the stair landing 85*a* and may have a small sliding window 120 over a washer 121. This module 47 includes a bathroom 122 with a vent 123, and a hot water heater with a vent 124. Again, the position of the bearing walls 111 and 112 is rotated 90° from that of the bearing walls 101 and 102 of the module 46, and, again, they overlie the bearing walls 81 and 82 of the module 44 below. Also, the wall 111 may serve as a party wall against a wall 103*b* of an adjoining module 46*b.*

The tube-shaped module 48, which abuts the modules 45 and 47, provides the third bedroom and has an exterior bearing wall 131 and an interior bearing wall 132 rotated 90° with respect to the bearing walls of the modules 45 and 47. An entranceway 133 to the master bedroom is provided through the bearing wall 132. An exterior non-bearing wall 134 is provided and there is an open end opposite thereto. The wall 134 may be insulated to provide a party wall lying against a wall 91*b* of a module 45b. The exterior bearing wall 131 may have a window 135, there is a floor 136 and an open beam ceiling for the unit 43 below, and a ceiling-roof assembly 137.

Finally, there is a clerestory module 49 of the inverted U-shaped type having a sloping open beam ceiling and a roof 141. There is a pair of sloping walls 142 and 143, which may be bearing walls, and a high non-bearing wall 144 containing the clerestory window 145, while at the other end there is a short roof projection 146 to extend over the closet 95. While the roof 141 is shown finished, the other roofs are shown unfinished; the finishing may be done at the factory or in the field.

The construction of the individual modules is less critical than their basic nature, but there are some significant features. Wood is a preferred material for one and two story buildings in most locations and will be used in the example here given. FIGS. 12 to 33 bring out several interesting points.

Figure 12:
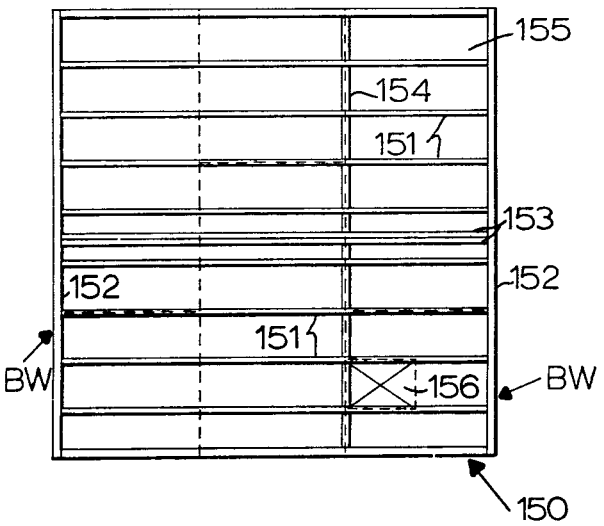
FIG. 12 is a top view of a partially completed typical floor panel of a ground-floor module of the building of FIG. 7 before installation of the plywood panels; the broken lines indicating where the plywood panel joint lines later meet, with the bearing walls labeled "BW".

The construction of a typical floor panel 150 for each of the ground-floor modules 41, 42, 43, 44 is shown in FIG. 12. The bearing walls are labeled "BW". The floor panel 150 may comprise construction joists 151, such as 2 × 8 inch Douglas fir joists placed sixteen inches on center, with rim joists 152 at each end, and these, too, may be 2 × 8's. Extra joists 153 may be provided at the center, as shown here. Cross blocking 154 may be provided to underlie a partition wall, where such is present. The joists 151 are spanned by a plywood floor base 155, shown here in phantom, which may be 1⅛' plywood. Any suitable floor covering, including wall-to-wall carpet or linoleum or tile, is applied, preferably in the field. A removable plywood panel 156 may be provided for interior plumbing, vents, and similar things, where needed, and is present in some modules and absent in others. Electrical wiring, not shown, is put in place in the factory, the wiring varying from module to module, the wiring being spliced in the field at junction boxes.

Figure 13:
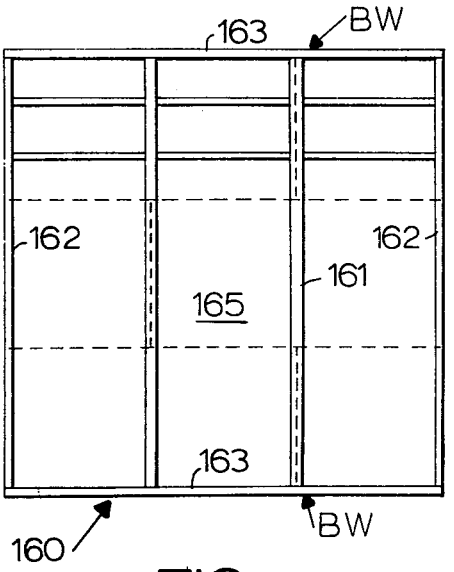
FIG. 13 is a similar top view of a typical intermediate floor panel of an upper floor module of the building of FIG. 7, with the plywood panels omitted and the future plywood panel joint lines indicated in broken lines, and with the bearing walls labeled "BW".

A floor panel 160 for intermediate units, such as those on second story of three-story buildings, or on the second and third stories of four-story buildings, may be like the example shown in FIG. 13, where the bearing walls are again labeled "BW". Here, there is an exposed timber construction with 4 × 8 inch beams 161, preferably placed 4 feet on center, with 2 × 8 rim joists 162 and 163. Typically these are made from Douglas fir. A covering 165 (shown here only in phantom) of 1⅛ inch re-sawn Douglas fir with the re-sawn side facing down may be provided in place of plywood on these floors, though plywood may be used. The result is both a floor and an open-beam ceiling for the U-shaped module below. A similar floor panel may be used in tube-shaped modules.

Figure 14:
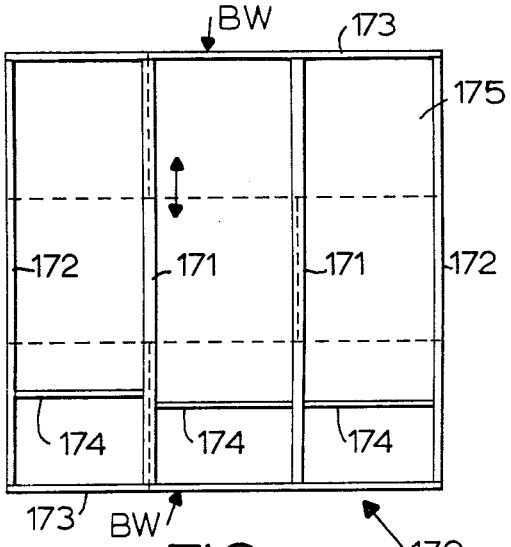
FIG. 14 is a top view of a typical roof panel of a top-floor "tube-shaped" module of the building of FIG. 7, again omitting the plywood panels but showing the joint lines, with the direction of joists indicated by arrows and the bearing walls labeled "BW".

A roof-ceiling panel 170, such as may be used in the three tube modules 46, 47, 48 is shown in FIG. 14, where bearing walls are once again labeled "BW". This panel 170 comprises 3 × 8 inch beams 171 and 2 × 8 inch rim joists 172 and 173 to provide a roof load of about 20 pounds per square foot. Joists 174 may be staggered to pick up partitions. The beams 171 may be spanned by ¾ inch plywood 175, shown here in phantom only. Rigid insulation (not shown) and roofing (not shown) are preferably applied in the field, but they can be factory installed too. The result in an open beam ceiling with a roof thereover. An attached dropped ceiling is also possible.

Figure 15:
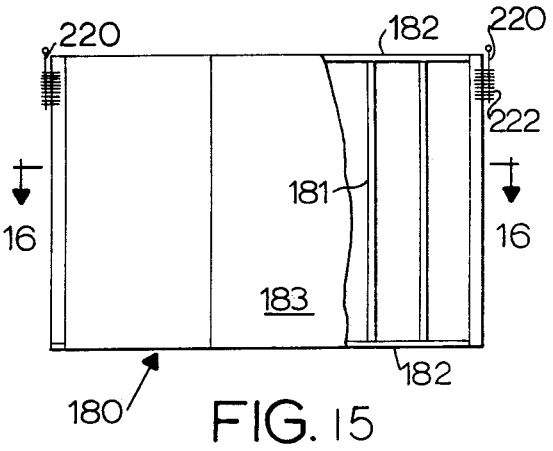
FIG. 15 is a view in elevation of a typical interior bearing wall of the building of FIG. 7, with the surface broken away.
Figure 16:
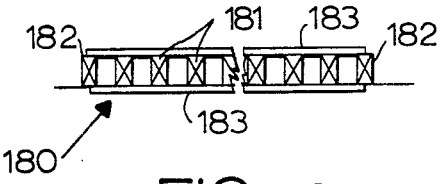
FIG. 16 is an enlarged view in section taken along the line 16—16 in FIG. 15, with the central portion broken to save space.

An interior bearing panel 180 is shown in FIGS. 15 and 16. These bearing panels 180 may be made of standard 2 × 4's 181 sixteen inches on center in a frame construction with top and bottom rails 182 and with half-inch gypsum board 183 on both sides, unless it is a party wall. The gypsum board 183 may be sheer nailed on the inside in seismic areas. For party walls there is insulation between a board 183 on the inside of one module and a similar board on the inside of another module adjacent thereto.

Figure 17:
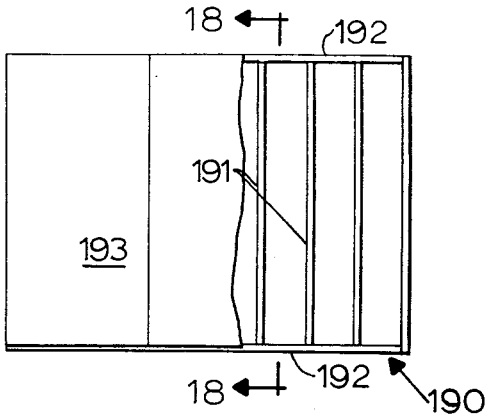
FIG. 17 is a view in elevation of another typical interior bearing wall of the building of FIG. 7, with the surface broken away.
Figure 18:
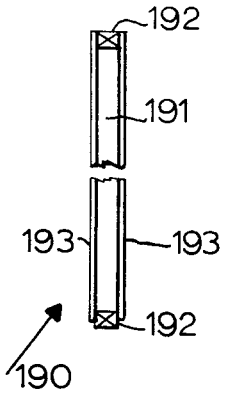
FIG. 18 is an enlarged view in section taken along the line 18—18 in FIG. 17 and broken in the middle in order to conserve space.

A typical interior non-bearing wall 190, shown in FIGS. 17 and 18, may be constructed of 2 × 3 inch standard studs 191 placed 16 inches on center with top and bottom rails 192 and with ½-inch gypsum board 193 on one side or on both sides, depending on whether it is a party wall or not. All of the panels, bearing or not, are prewired and, in the case of party walls, they are also pre-plumbed at the factory.

Figure 19:
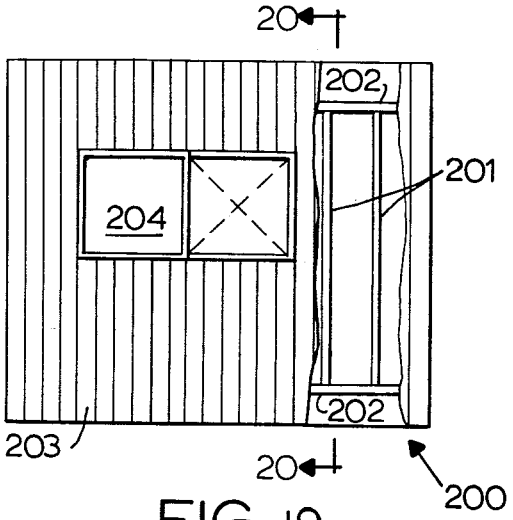
FIG. 19 is a view in elevation of a typical exterior bearing wall of the building of FIG. 7, with the surface broken away.
Figure 20:
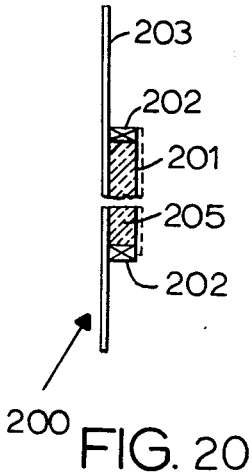
FIG. 20 is an enlarged view in section taken along the line 21—21 in FIG. 19 and broken in the middle in order to conserve space.

A typical exterior bearing wall 200 is shown in FIGS. 19 and 20. This may again be made from 2 × 4 inch timber 201 placed 16 inches on center with top and bottom rails 202 and with ⅜ inch re-sawn redwood plywood 203 spanning the 2 × 4's 201. Windows 204 or doors may be provided where needed. This wall 200 may be used as a shear wall in a high seismic zone area. In all of the panels, any material may be used for closing and finishing the frame relative to local needs and government codes. Each exterior bearing panel 200 is preferably also stuffed with fiberglass or other thermal insulation 205.

Figure 21:
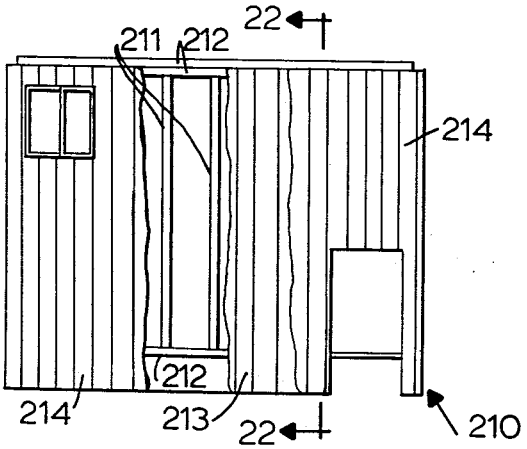
FIG. 21 is a view in elevation of another typical exterior non-bearing wall of the building of FIG. 7, with the surface broken away.
Figure 22:
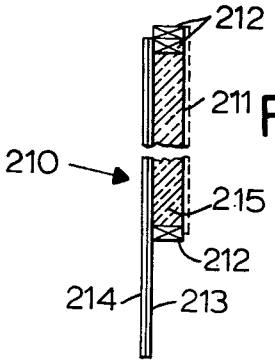
FIG. 22 is an enlarged view in section taken along the line 22—22 in FIG. 21 and broken in the middle in order to conserve space.

A typical exterior non-bearing panel 210 is shown in FIGS. 21 and 22. This may be of standard 2 × 4's 211 placed 16 inches on center in a frame construction with top and bottom rails 212. Although non-bearing, the wall 210 acts as a shear wall in seismic areas and therefore preferably includes plywood 213 shear nailed and preferably covered with ⅜ inch re-sawn redwood 214, though other suitable structure may be used. Again, insulation 215 may be provided.

Figure 23:
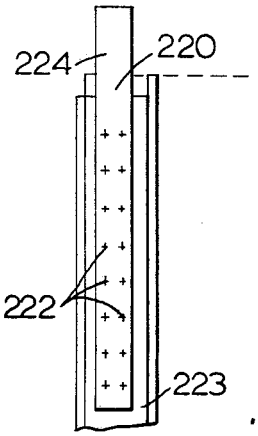
FIG. 23 is a fragmentary view in side elevation of an expendable strap useful in placement of a module of FIG. 9, shown connected to such a module.
Figure 25:
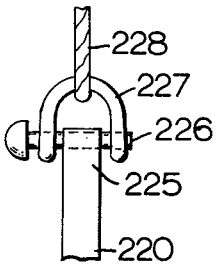
FIG. 25 is an enlarged fragmentary view in side elevation of the strap of FIGS. 23 and 24 with the shackle and lifting cable installed.
Figure 26:
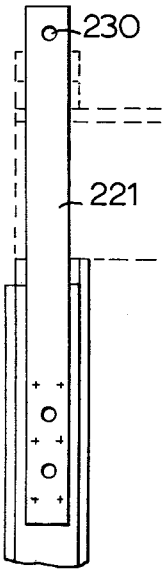
FIG. 26 is a fragmentary view in side elevation, like FIG. 23, of a reusable strap used for module placement.
Figure 27:
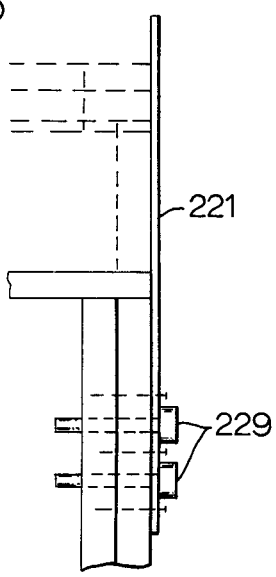
FIG. 27 is a view in end elevation, like FIG. 24, of the reusable strap of FIG. 26.

FIGS. 23 through 27 show two expedients relating to lifting hardware material that may be used for setting the modules in place by crane. FIGS. 23 through 25 show expendable metal straps 220, while FIGS. 26 and 27 show reusable metal straps 221. The straps for the tube-shaped modules are longer because of the additonal module height. The reusable straps 221 are used where they can be removed after erection, whereas the expendable straps 220 are used where they cannot be removed after erection. The expendable straps 220 may comprise a 2 × 22 galvanized strap secured by 16-penny nails 222 to studs 223. Where they cannot be reused, the extending upper portion 224 is cut off after erection or is bent down. At the upper portion, by providing a fold 225 at the top with a lap, there is a receptacle for a pin 226 that also engages a shackle 227 for a crane pickup cable 228.

The reusable straps 221 (FIGS. 26 and 27) are temporarily nailed. Two ⅝ inch steel dowels 229 with heads take the weight of the module. When they have been lifted, in a similar manner, they are easily taken out, by slipping them in or out. The straps 221 may be made from steel plate and may have a hole 230 to receive a suitable shackle corresponding generally to what is shown in FIG. 19 but perpendicular to that one.

Figure 28:
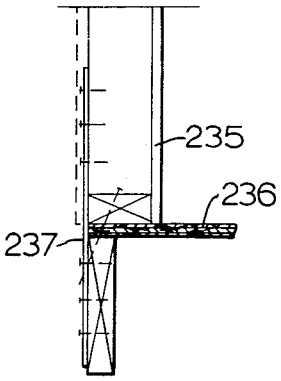
FIG. 28 is a fragmentary view in elevation and in section of a typical connection between a wall panel and a floor panel in the building of FIG. 7.

FIG. 28 shows a typical connection of a wall panel 235 to a floor panel 236 in a typical module. Module tie straps 237 of sheet metal are nailed from the wall panel 235 to the floor panel 236 in addition to standard plate nailing 238.

Figure 29:
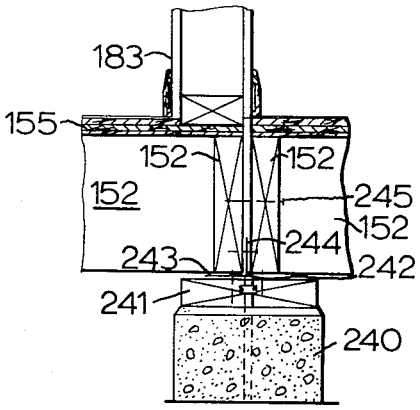
Figure 30:
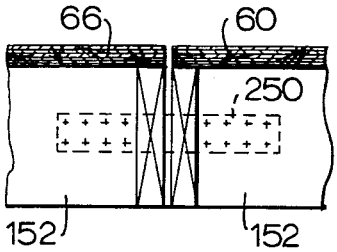
FIG. 30 is a fragmentary view in elevation and in section of the connection of one open floor to another in the building of FIG. 7.
Figure 31:
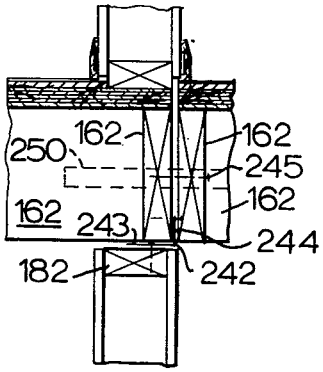
FIG. 31 is a fragmentary view in elevation and in section of the connection of a pair of typical "U-shaped" modules of FIG. 9 to a pair of "tube-shaped" modules above them.
Figure 32:
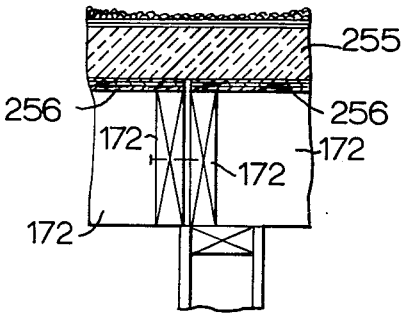
FIG. 32 is a fragmentary view in elevation and in section of a typical connection of a typical "tube-shaped" module to another "tube-shaped" module at the roof level in the building of FIG. 7.
Figure 33:
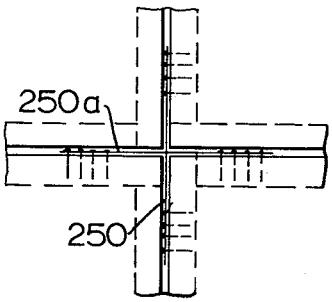
FIG. 33 is a top plan fragmentary view of a typical intermediate floor corner connection where four modules come together, in the building of FIG. 7.

FIGS. 29 through 31 show how modules may be connected to each other at the site. While the modules are being constructed and prefinished in the factory, site preparation is preferably being completed, because it is not desirable to have to store the modules for a considerable time. The site preparation comprises pouring the footings and placing the utilities into the ground ready to be connected to the utility systems that are preinstalled in the module. The modules arrive at the site braced by suitable framing and protected by polyvinyl chloride coverings. In most instances they are transported by truck, although they may be transported by helicopter or other means. A crane at the site removes each module from the truck, swings it around, and sets it on a footing 240. Then the module is nailed to a mud sill 241 of the footing, as shown in FIG. 29, with the aid of L-shaped footing anchor plates 242. Then the utility connections are made, the electrical connections being made at junction boxes for outlets and fixtures. The closure strips and connection joints are applied to complete the process.

Because there is an exposed beam ceiling, there is easy access to the modules in order to make the necessary connections at the tops of the modules and at the bottoms of the upper modules. Specific sizes of nails are used so that the nail tips do not protrude and create unsightly appearances. In the vertical direction, the modules are connected by means of the L-shaped framing anchors 242, a horizontal leg 243 of which is first nailed down either to a mud sill 241 (FIG. 29), or to the top plate 182 of the wall of another module (FIG. 31). A vertical leg 244 is then attached by nailing horizontally to it through the rim joist 152 or the floor beams 162 of the module above. The adjacent module may be connected simply by nails 245 through adjacent rim joists 152 or beams 162, (FIGS. 29 and 31).

Attached tie strips 250 are used where two or four modules come together. These strips 250 are free nailed to joist 152 or 162 of the first module, which is set in place, and then are nailed to the next module (FIGS. 30 and 31). When four modules come together (FIG. 33), two strips 250 and **250*a*** are used, one above the other and crossing over it.

The roof 255 is built up over the ceiling 256 of tube-shaped modules (see FIG. 32), after the joists 172 are nailed together, which is easy because of the open beam ceiling.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A modular building construction system including in combination:

a series of room-size rectangular first modules, each having in assembly only two vertical bearing planes parallel to each other, each said bearing plane having a plurality of vertical load-bearing structural members joined by a rectangular floor panel having a series of load-carrying spanning means running between said bearing planes, each said first module having said floor panel terminated at two sides at non-bearing planes, each said module being open on top, and a series of room-size rectangular second modules, each having only two vertical bearing planes parallel to each other and provided with a plurality of vertical load-bearing structural members and joined by both a rectangular floor panel and a rectangular ceiling panel, both of which have a series of load-carrying spanning means running between their said bearing planes and both of which have two sides terminated at non-bearing planes, a plurality of said modules being used at each story of a plural-story structure made by stacking some modules on others, each module of each upper story being placed on a module of a lower story with the bearing planes of those modules aligned to carry their load vertically, means associated with each said floor panel and with each said ceiling panel for transferring the load from the said panel to the two bearing planes between which it extends, whereby substantially all the loads are transmitted vertically along the bearing planes, said second modules being used only at the top of a vertical stack of said modules and the first modules being used on all stories except the top of said stack, and the floor panel for any one upper module forming a ceiling panel for a module on a lower story so that redundancy of floor-ceiling structure is avoided, each said bearing plane of any one said module being perpendicular to the bearing planes of each adjacent module on the same story and adjacent a non-bearing plane side of said adjacent module, so that redundancy of bearing planes from module to module can be avoided and thereby, where walls are used at bearing planes, redundancy of such walls can be avoided and earthquake resistance of the building is enchanced.

2. The system of claim 1 wherein said modules have factory-prefinished interiors and means for securing said modules together both vertically and horizontally, said means for securing lying entirely outside said prefinished interiors.

3. The system of claim 1 wherein said modules are constructed of wood with said spanning means being wooden joists and said vertical load-bearing structural members being columnar lumber members.

4. The system of claim 1 wherein each said floor panel comprises wooden rim joists, a series of parallel joists between two rim joists joining the two bearing planes of its module, and a flat wooden surface secured to and supported by said joists.

5. The system of claim 4 wherein said flat wooden surface comprises plywood panels.

6. The system of claim 4 wherein each said floor panel is secured to a structural member at and lying on each said bearing plane by an exterior plate nailed to both said floor panel and said structural member.

7. The system of claim 4 wherein said ceiling panel provides an open beam ceiling with exposed rim joists, so that abutting rim joists of adjacent modules can be nailed together.

8. The system of claim 4 wherein the floor panel of each said module on a story above the lowest provides an open-beam ceiling for a module therebelow, with exposed rim joists so that abutting rim joists of adjacent modules can be nailed together.

9. The system of claim 1 wherein each said module is square.

10. The system of claim 1 wherein at each end of each said bearing plane of each said module there is secured a metal strap at the upper end thereof, said metal strap having a portion extending above said module and providing means for attachment to a lifting device, for lifting said module and putting it in place.

11. The system of claim 10 wherein said straps are permanently secured to said modules, the portion extending above the module later being severed therefrom after installation.

12. The system of claim 10 wherein said strap is removably secured to each said module and is fully removed after installation of the module.

13. The system of claim 1 wherein some modules have at least one non-bearing wall at one end coinciding with a said non-bearing plane between and perpendicular to the bearing planes thereof.

14. The system of claim 1 wherein some modules have an exterior wall provided with insulation and closed on its inside surface only, for abutment against a like wall in an adjacent housing unit to serve as a party wall.

15. A modular building construction system including in combination:

a plural-story structure made up of vertically stacked square modules, there being a plurality of modules for each sotry, each module above the lowest level being stacked directly on a module below, the vertical forces of the building from the top to the ground being transmitted in a series of vertical planes one module wide, every module on the top only of a vertical stack having a floor and a ceiling, both of which have a series of parallel load-carrying spanning means extending across said module in the same direction for both floor and ceiling, every module except those on the top of a vertical stack having no ceiling but having a floor with a series of parallel load-carrying spanning means extending across said module, every module having only two vertical bounding planes, one at each end of said load-carrying spanning means, providing load-transmitting means for the said load-carrying spanning means thereabove and lying in one of said series of vertical planes, each said bounding plane having a plurality of vertical load-bearing structural members, there being beam means at each end of said load-carrying spanning means for transferring the load therefrom to said vertical bounding planes, said modules in each vertical stack being exactly aligned to place all the bounding plane thereof in alignment, while the modules on each story are conjugated so that each said bounding plane of one module is perpendicular to the bounding planes of each module on the same story which is immediately adjacent thereto, whereby redundancy of walls of adjacent modules lying along the bounding planes can be avoided and protection against earthquake forces increased.

16. The system of claim 15 wherein said modules are constructed of reinforced concrete and said spanning means and said vertical load-bearing structural members constitute steel reinforcing means.

17. The system of claim 15 wherein the modules on each story are arranged so that at intervals four said bearing planes meet at a locus defining an open space, and said means for securing comprises steel rods extending vertically through said open spaces, means for securing a series of said rods in vertical succession, and bearing and clamping means urged against horizontal upper surfaces of said bearing planes by said means for securing.

18. A building construction method, comprising:

pre-constructing and pre-finishing the interiors of a series of room-size rectangular first modules, each having only two vertical bearing planes parallel to each other, each said bearing plane having a plurality of vertical load-bearing structural members joined by a floor panel having a series of load-carrying rectangular spanning means running between said bearing planes, each said module being open on top, the vertical end planes of each said first module that lie perpendicular to the bearing planes being non-bearing, pre-constructing and pre-finishing the interior of a series of room-size rectangular second modules, each having only two vertical bearing planes parallel to each other and provided with a plurality of vertical load-bearing structural members and joined by both a floor panel and a ceiling panel, both of which have a series of load-carrying spanning means running between their said bearing planes, the vertical end planes of each said second module that lie perpendicular to a bearing plane being non-bearing, placing a group of said first modules on a first story level with each said bearing plane of any one said module being perpendicular to the planes of the bearing planes of each adjacent module on the same story and adjacent a non-bearing end plane of said adjacent module, providing other stories by stacking modules on modules, each module of each upper story being placed on a module of lower story with the bearing planes of those modules aligned to carry their load vertically, said second modules being used only at the top of a vertical stack of said modules and the first modules being used on all stories except the top of said stack, with the floor panel of any one upper module forming a ceiling panel for a module on a lower story.

* * * * *